US006389778B1

(12) United States Patent
Strange

(10) Patent No.: US 6,389,778 B1
(45) Date of Patent: May 21, 2002

(54) MODULAR WALL PANEL STRUCTURE

(75) Inventor: J. V. Strange, Aubrey, TX (US)

(73) Assignee: Itec Steel Corporation, Denton, TX (US)

( * ) Notice: Subject to any disclaimer, the term of this patent is extended or adjusted under 35 U.S.C. 154(b) by 0 days.

(21) Appl. No.: 09/563,309

(22) Filed: May 2, 2000

(51) Int. Cl.[7] ..... E04B 1/00; E04G 21/00; E04G 23/00

(52) U.S. Cl. ..... 52/745.19; 52/210; 52/238; 52/481.1; 52/376; 52/348; 52/349; 52/350; 52/220.1; 52/664; 52/656.1; 52/241; 52/242; 52/285; 52/281; 52/690; 52/695

(58) Field of Search ..... 52/745.19, 210, 52/238, 48.11, 376, 348, 349, 350, 220.1, 664, 656.1, 241, 242, 285, 281, 690, 695

(56) References Cited

U.S. PATENT DOCUMENTS 4,235,054 A * 11/1980 Cable et al. ..... 52/745.19
4,648,216 A * 3/1987 Reaves et al. ..... 52/745.19
5,685,115 A * 11/1997 Colfer ..... 52/745.19

* cited by examiner

*Primary Examiner*—Beth A. Stephan
*Assistant Examiner*—Chi Q Nguyen
(74) *Attorney, Agent, or Firm*—John W. Vandigriff

(57) ABSTRACT

A prefabricated modular wall panel brace is used in the construction of long wall for buildings. Each prefabricated modular panel brace is placed beside another framing component between a top plate and a bottom plate. Every other panel maybe inverted with respect to the adjacent panel so that the ends of a diagonal brace in each panel is adjacent to the diagonal brace in the adjacent panel. Each panel may have a movable/swiveling section to accommodate an angled portion of the wall. The modular wall panel brace may be used in single or multiple floor structures for either interior or exterior walls to provide shear or diaphragm bracing of the wall units of a building to provide bracing for wind or seismic loads.

15 Claims, 7 Drawing Sheets

MODULAR WALL PANEL STRUCTURE

FIELD OF THE INVENTION

The invention relates to wall structures, and more particularly to a modular shear metal wall structure unit that is prefabricated and adaptable for the bracing of and construction of building wall structures in light gauge steel that will withstand wind and seismic loads.

BACKGROUND OF THE INVENTION

It has been common practice to build prefabricated roof structures of wood. Some wall structures have been fabricated also of wood. U.S. Pat. No. 4,648,216 describes several wood prefabricated wall and roof structures that use metal interconnecting plates.

U.S. Pat. No. 2,067,403, shows a metal building structure in which elements called channel elements are secured to gather to form the walls and other structures. The single channel elements are used to form the fame of the walls.

In U.S. Pat. No. 4,597,813, a building wall is made using a metal frame which is braced with stiffening members that have an I-beam shape.

SUMMARY OF THE INVENTION

The invention is a prefabricated wall section that is used in the construction of steel framed walls for buildings and performs as the bracing mechanism for the building structure. Each prefabricated section is placed separately or beside another section between a top plate and a bottom plate. Every other panel maybe upside down with respect to the adjacent panel so that the ends of a diagonal brace in each panel is adjacent to the diagonal brace in the adjacent panel, but multiple configurations may be used in which some adjacent panels are of the same orientation of the adjacent panel. Each panel may have a movable or swiveling section to accommodate an angled portion of the wall.

BRIEF DESCRIPTIONS OF THE DRAWINGS

Figure 5B:
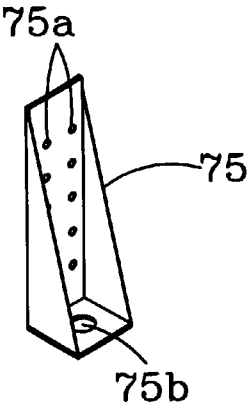
FIG. 5 is a partial view of a wall panel and part of a base plate.
Figure 5A:
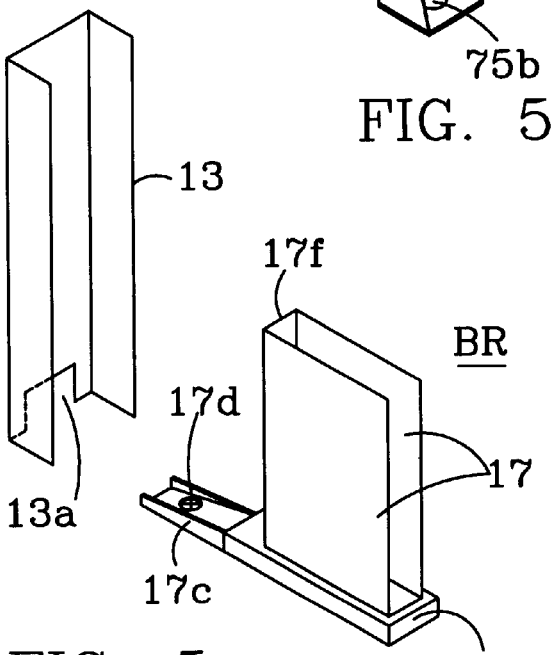
Figure 6:
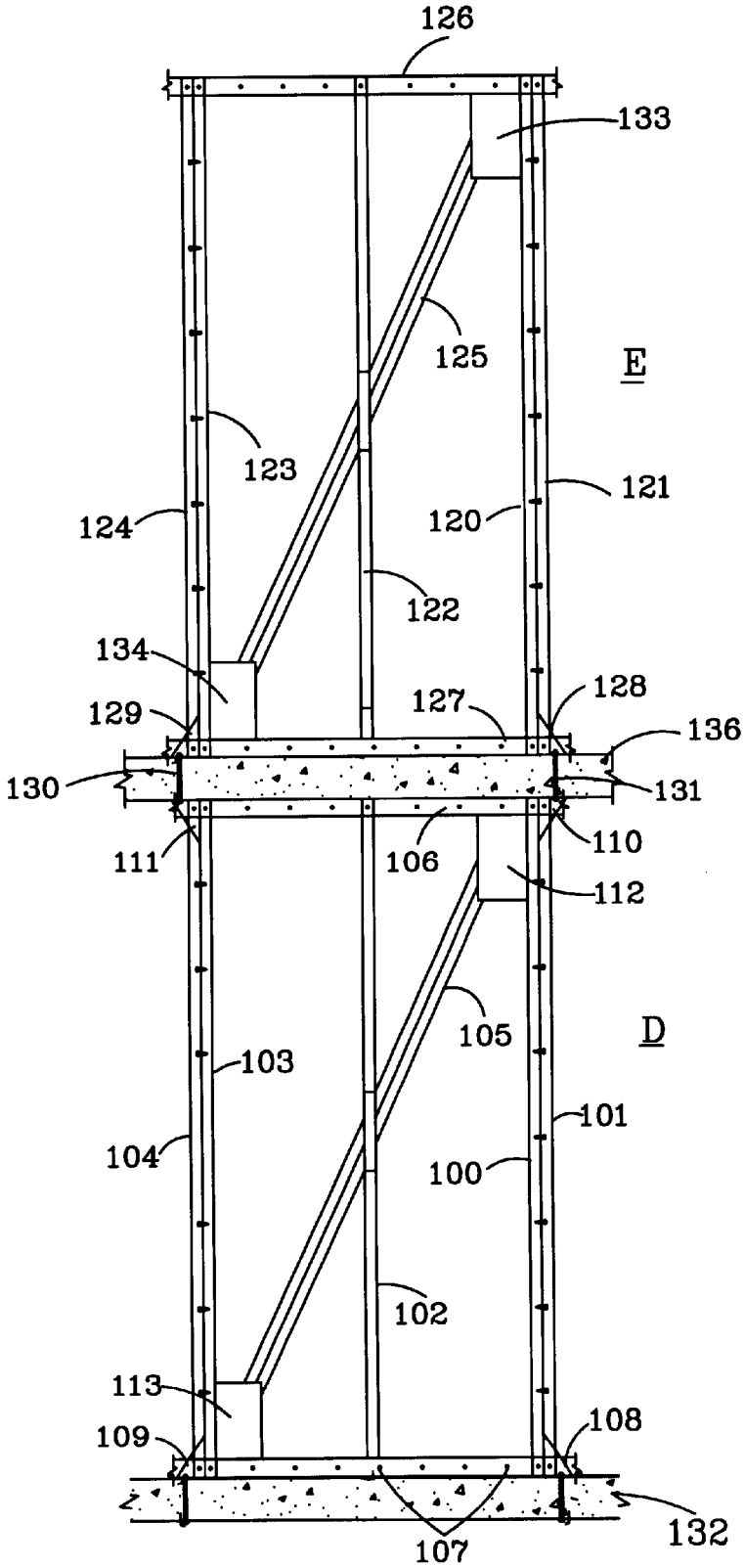
Figure 7:
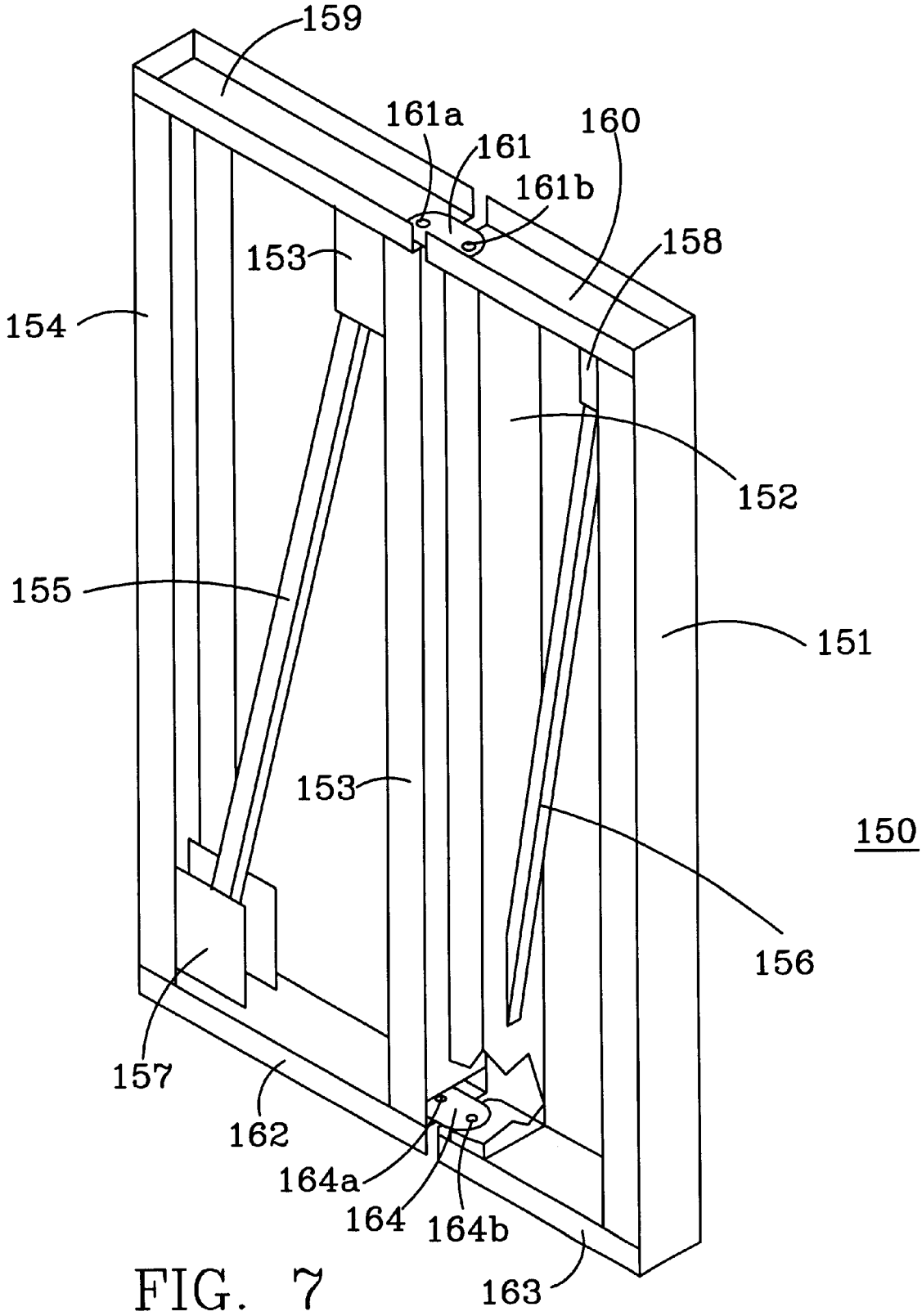

FIG. 5*a* shows an example of a corner bracket in detail;

FIG. 5*b* shows an example of an angled bracket;

FIG. 6 shows two vertically aligned wall panels for first and second floors of a building; and FIG. 7 shows a wall panel with two movable parts.

Figure 8:
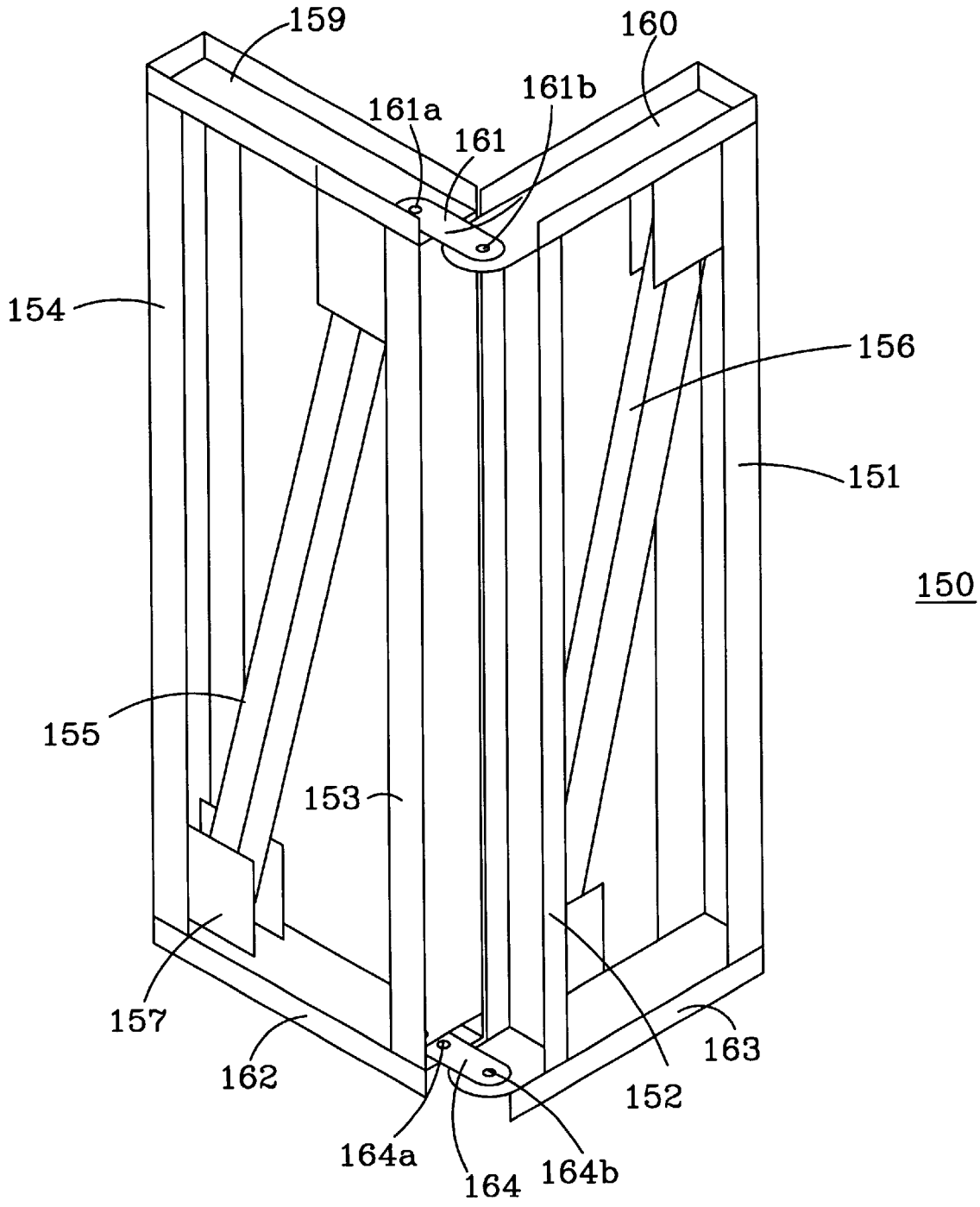

FIG. 8 shows a wall panel with two movable parts positioned at an angle with respect of the other.

DESCRIPTION OF A PREFERRED EMBODIMENT

Figure 1:
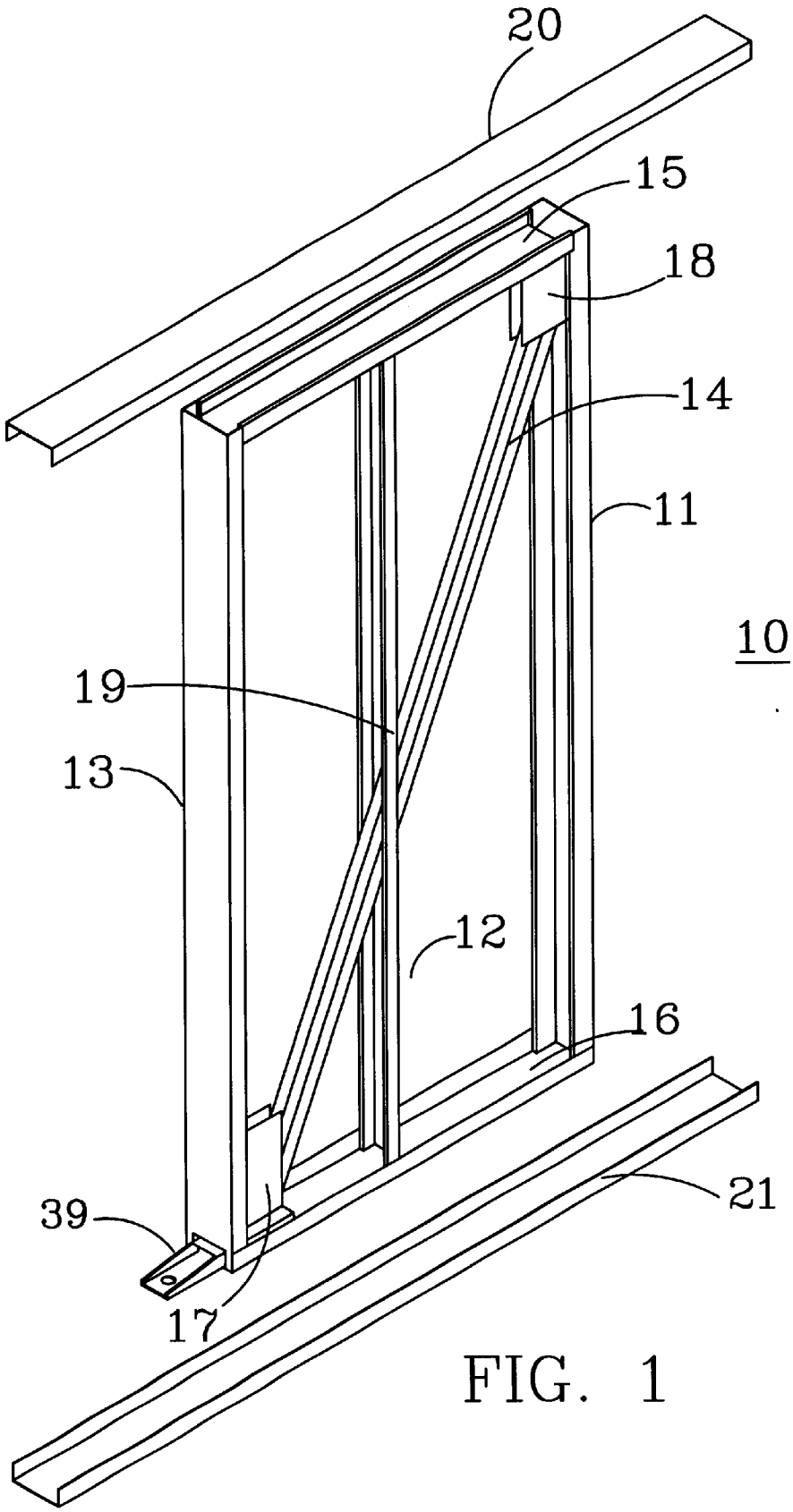
FIG. 1 is an isometric view of a wall panel according to the invention with the top and bottom plates.

FIG. 1 is an isometric view of wall panel 10. Panel 10 is constructed of two outside side C-shaped vertical metal members 11 and 13, central vertical member 12, a diagonal brace 14, and a top member 15 and a bottom member 16. Each of the vertical members, the top and bottom members, and the diagonal member are secured together, by one of, or a combination of, welding, bolts, angle cups, and metal screws. Diagonal brace 14 extends through an opening 19 in the central vertical member 12, and is secured on each end by corner brackets or panels 17 and 18. A corner bracket is secured to its respective vertical member (11 or 13) and to brace 14 by screws bolts, or welding, and panels 17 and 18 also form a brace between each of the outside vertical members 11 and 13, and the top member 15 and bottom member 16. Panels 17 are attached to, and may be a part of a shoe bracket having a foot 39 extend out from the vertical member and secured to the floor to brace the panel. More detail of a the corner bracket is illustrated in FIG. 5*a*.

Wall panel 10 is placed in the bottom track 21 of a building wall that is either an interior or exterior wall. Bottom track 21 is secured to the foundation, for example, a concrete slab. Panels 10 are mounted in bottom track 21 and secured to the track, and through the track to the foundation.

A second track 20 is placed over the top of a single or series of wall panels 10, where each of the panels 10 is secured to the top track 20. Depending upon the structural design of the building, for wind and seismic loads, another structure member maybe place over the top of continuous track 20, and track 20 is secured to this top additional structural member.

Figure 2:
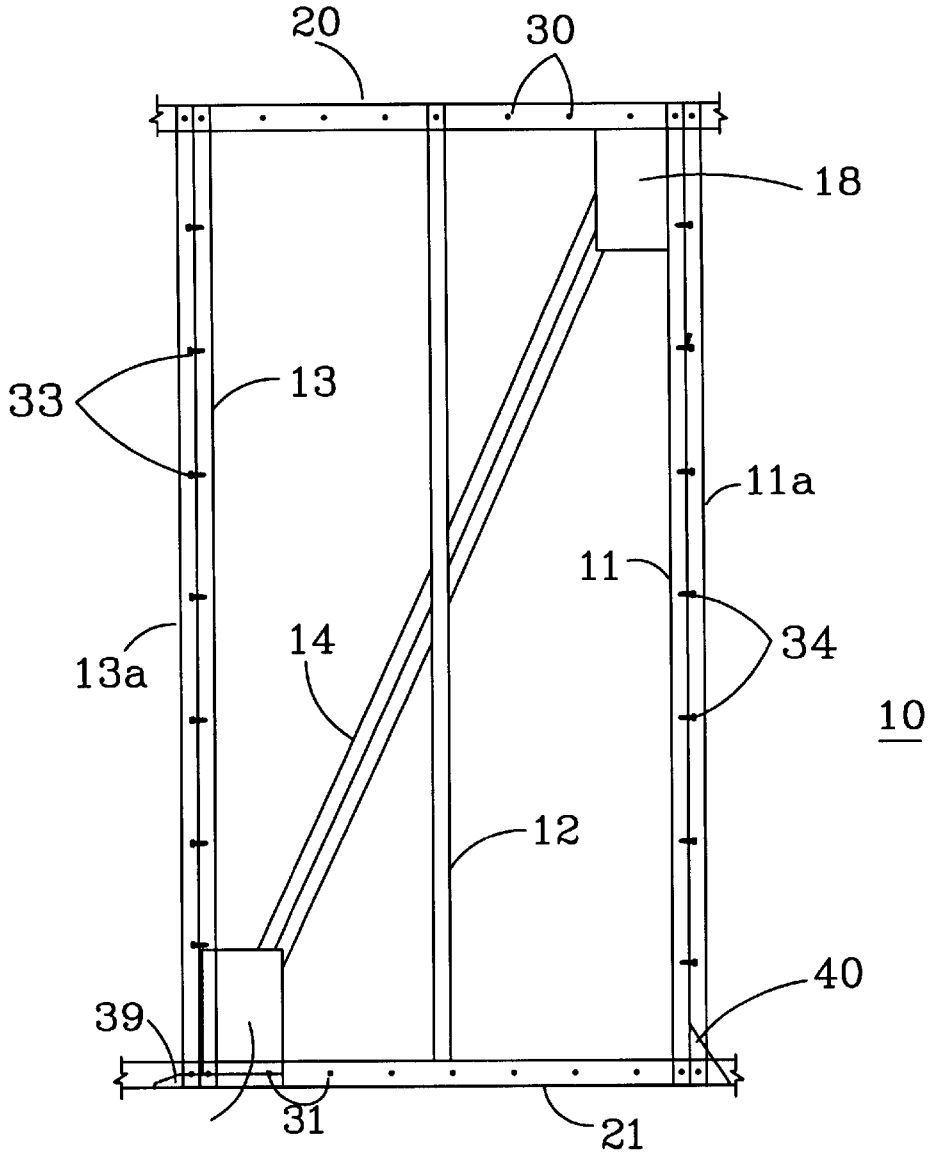
FIG. 2 is a side view of a wall panel.

FIG. 2 is a side view of wall panel 10. In FIG. 2, each of vertical members 11 and 13 are attached to adjacent vertical members 11*a* and 13*a*, respectively. The adjacent members 11*a* and 13*a* are either a part of adjacent panels which are attached together by a plurality of screws or bolts, or wall framing for which the brace is required. For example, members 11 and 11*a* are attached together by screws 34, and members 13 and 13*a* are attached together by screws 33.

Bottom member 16 (FIG. 1) is mounted inside of bottom track 21 and is attached to track 21 by screws, bolts, or welding 31. Similarly, top member 15 (FIG. 1) is mounted in the top continuous track 20, and secured thereto by screws, bolts, or welding 30 (FIG. 2). Brace 14 extends through center vertical member 12 and is secured on each end by corner brackets 17 and 18, which also serve as braces between it respective vertical member and top, or bottom member. To additionally secure the wall panels to the floor or foundation, hold down brackets 39 (a part of panel 17) and 40 are secured to the vertical members 11 and 13, and to the floor or foundation with bolts, as shown in more detail in FIGS. 5 and 5*a*.

Figure 3:
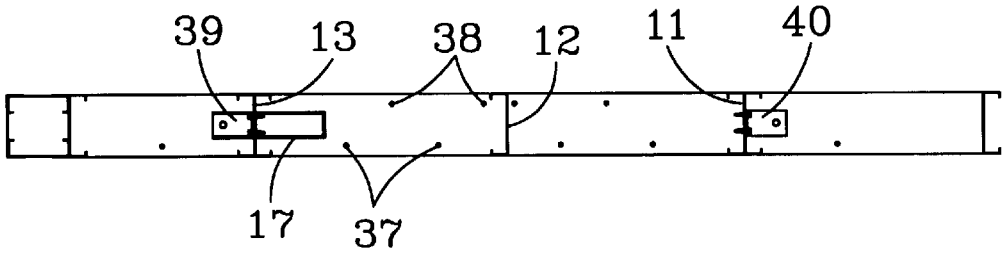
FIG. 3 is a bottom view of a wall panel.

FIG. 3 is a view looking down upon the bottom member 16 inside continuous track 21. Brackets 39 and 40 are shown attached to vertical members 13 and 11, respectively. A plurality of screws or bolts 37 and 38 are shown attached bottom track 16 to continuous track 21, and to the floor or foundation.

Figure 4:
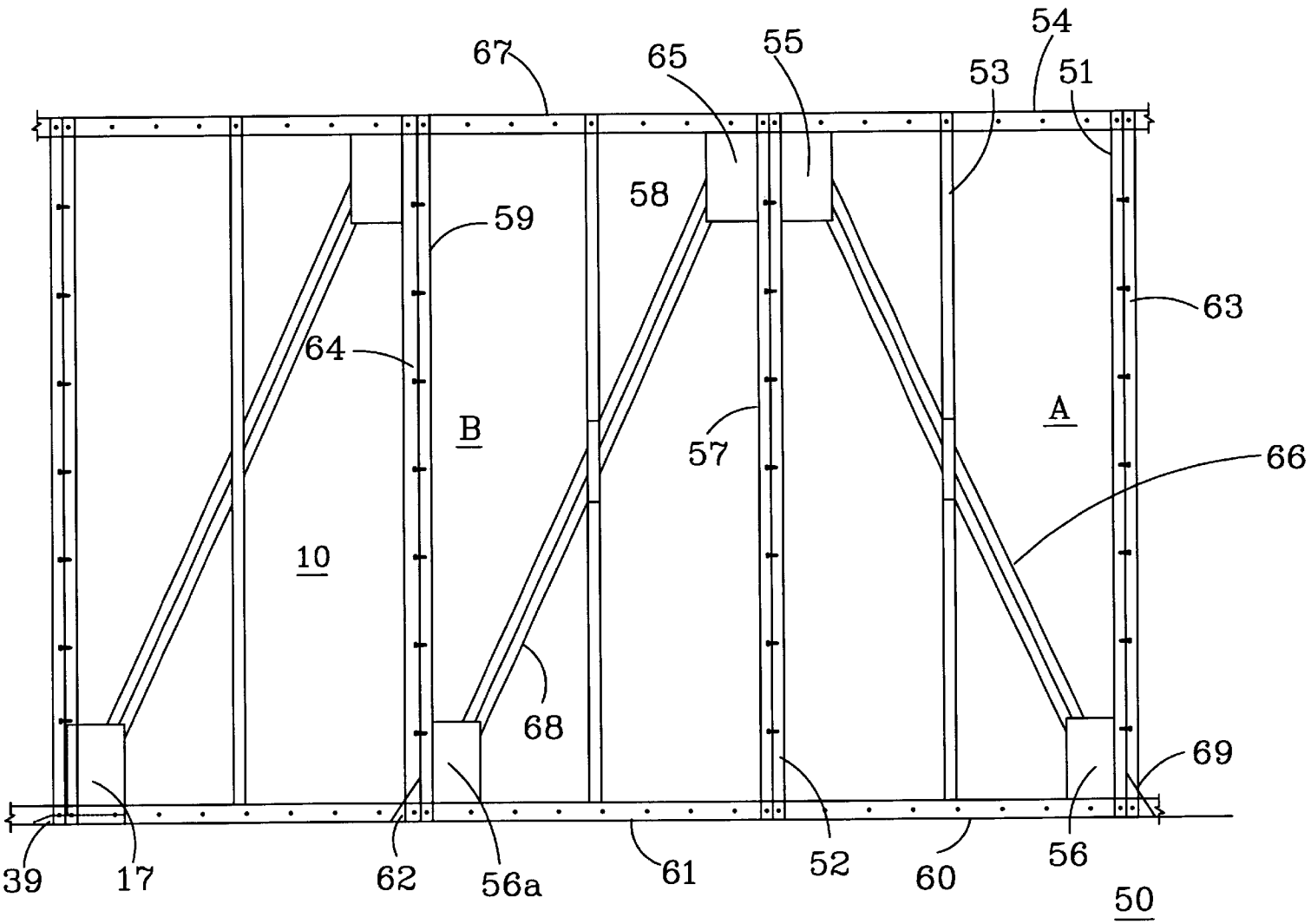
FIG. 4 is a side view of three adjacent wall panels.

FIG. 4 show a partial wall construction where three wall panels 10 (of FIGS. 1 and 2), A and B are mounted side by side with panel A inverted with respect to panel B. Panel A has vertical members 51, 52 and 53 and horizontal top and bottom members 54 and 60. Diagonal brace 66 extends between members 52 and 51 and are attached thereto and supported by panels 55 and 56. Panel B has vertical members 57, 58 and 59 and horizontal top and bottom members 61 and 67. Diagonal brace 68 extends between members 57 and 59 and are attached thereto and supported by corner brackets 65 and 56*a*. Diagonal brace 68 is inclined to the right and diagonal brace 66 is inclined to the left so that they extend to common corners of panels A and B. The combination 50 of panels A and B are secured to the floor or foundation by angled brackets 62 and 69. Angled bracket is actually in panel 10, and the other end of panel 10 is secured by a bracket made up of panels 17 and bracket 39.

Figure 5:
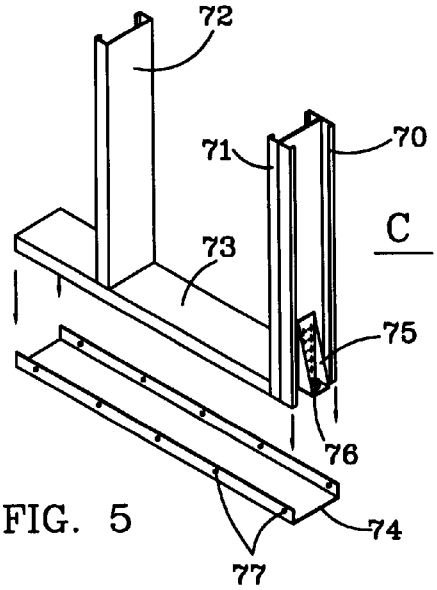

FIG. 5 shows in detail the attachment of panel C to a floor or foundation. The vertical member 70 and 71 of two adjacent panels are secured together and to base member 73. Center member 72 is shown attached to base 73. Panel C is placed in track 74 and secured therein by a plurality of screws 77. Also Panel C and the adjacent panel (only member 70 is shown) are attached to the floor or foundation by angled bracket 75 by a bolt 76. Bolt 76 may be a bolt, for example, partially embedded in a concrete foundation, or any other type anchor bolt that can be used to anchor in wood or concrete.

FIG. 5*a* shows shoe bracket BR that is made up of panels 17, a base 17*a*, and a tapered section 17*c* with a mounting hole 17*d*. Tapered section and a part of base 17*a* is placed in an opening 13*a* in vertical member 13. A connecting wall 17*f*, connecting the two panels 17, is attached to vertical member 13, and the vertical member, and bracket BR is attached to the mounting service by a bolt 17*d*.

FIG. 5*b* shows an angled bracket 75 that is attached to a vertical members (70, 71 in FIG. 5) by screws through openings 75*a*, or by welding, to hold the panel including vertical members 70, 17 to the mounting surface. An opening 7*b* is used to secure the panel to a mounting surface.

FIG. 6 shows two vertically aligned wall panels for first and second floors of a building. Two panels, D and E, are aligned vertically, one over the other. Panel D has two vertical members 100 and 103, which are attached to member 101 and 104, respectively, of adjacent panels, or wall framing (not illustrated). Diagonal member 105 is attached to panels 112 and 113 and to a top member (not shown) that is in and secured to top track 106, and to a bottom member (not shown) that is in and secured to track 107. Panel D is secured to floor 132 by brackets 108 and 109.

Panel E has two vertical members 120 and 123, which are attached to member 121 and 124, respectively, of adjacent panels or wall framing (not illustrated). Diagonal member 125 is attached to corner brackets 133 and 134 and to a top member (not shown) that is in and secured to top track 126, and to a bottom member (not shown) that is in and secured to continuous track 127. Panel E is secured to floor 136 by brackets 128 and 129. Fixed bolts 130 and 131 may extend complete through floor 136 secure brackets 110, 111, 128 and 129 to floor 136.

FIG. 7 illustrates a panel 150 that may be angled to accommodate an angle or offset in a wall. Panel 150 has two vertical side members 151 and 154. There are two internal vertical members 152 and 152. The top member is in two parts 159 and 160 which are hinged together by strap 161 attached to each of 159 and 160 by rivets, screws or bolts 161*a* and 161*b*. Similarly, the bottom member is in two hinged parts 162 and 163. Parts 162 and 163 are hinged by strap 164 which is movably attached to each of parts 162 and 163 with rivets, screws or bolts 164*a* and 164*b*. There are two diagonal braces 155 and 156. Brace 155 extends between plates 157 and member 153, and brace 156 extends between plates 158 and member 152.

FIG. 8 shows panel 150 with the two parts angled with respected to one another.

What is claimed is:

1. A prefabricated modular wall panel bracing system, comprising:

first, second and at least a third spaced apart vertical members;

first and second end members attached, respectively, to opposite ends of the vertical members to form a panel;

a diagonal member extending from a first end of said first vertical member to a second end of said second vertical member, and extending through an opening in said at least third vertical member; and at least one corner bracket and hold-down connector at each end of said diagonal member.

2. The wall panel system according to claim 1, including a modular section allowing one portion of said panel to be placed at an angle with respect to the another portion of said panel.

3. The wall panel system according to claim 1, including top and bottom continuous tracks in which at least one wall panel is mounted.

4. The wall panel system according to claim 1, wherein each set of at least two panels include at least two brackets for securing the panels to a foundation.

5. The wall panel system according to claim 1, wherein said vertical members, end members, and diagonal member are constructed of steel bent in the form of a C.

6. A prefabricated wall panel system, comprising:

first, second and at least a third spaced apart vertical members;

first and second end members attached, respectively, to opposite ends of the vertical members to form a panel;

a diagonal member extending from a first end of said first vertical member to a second end of said second vertical member, and extending though an opening in at least one other vertical member; and top and bottom tracks in which a plurality of wall panels are mounted.

7. The wall panel system according to claim 6, including at least one corner brace at each end of said diagonal member.

8. The wall panel system according to claim 6, including a section allowing one portion of said panel to be placed at an angle with respect to the another portion of said panel.

9. The wall panel system according to claim 6, wherein each panel includes at least two brackets for securing a wall panel to a foundation.

10. The wall panel system according to claim 6, wherein said vertical members, end members, and diagonal member are constructed of sheet metal bent in the form of a C.

11. The wall panel system according to claim 6, including a shoe bracket for securing at least one end of a wall, including at least one wall panel, to a foundation.

12. A method of making a wall panel system, including the steps of:

forming a panel having first and second vertical members connected to a top and a bottom member;

securing at least one other central vertical member at each end to said top and bottom members between said first and second vertical beams;

securing a diagonal member through an opening in said other central vertical member and between an intersection of said first vertical member and said top member and an intersection of said second vertical member and said bottom member.

13. The method according to claims 12, including the step of securing at least one corner bracket at each end of said diagonal member where it is secured to a vertical member and said one of said top and bottom members.

14. The method according to claim 12, wherein at least one other adjacent panel is inverted with respect to the adjacent panel.

15. The prefabricated modular wall panel according to claim 1, including a hold-down connector at the bottom of each first and second vertical members.

* * * * *